US007905623B2

(12) United States Patent
Chen

(10) Patent No.: US 7,905,623 B2
(45) Date of Patent: Mar. 15, 2011

(54) MAGNETIC ILLUMINATION DEVICE FOR TOOL

(76) Inventor: Ming-Nan Chen, Taichung (TW)

( * ) Notice: Subject to any disclaimer, the term of this patent is extended or adjusted under 35 U.S.C. 154(b) by 93 days.

(21) Appl. No.: 12/458,292

(22) Filed: Jul. 8, 2009

(65) Prior Publication Data

US 2011/0007502 A1 Jan. 13, 2011

(51) Int. Cl.
*F21L 4/00* (2006.01)

(52) U.S. Cl. ..... 362/191; 362/190; 362/157

(58) Field of Classification Search ..... 362/191, 362/190, 398, 157
See application file for complete search history.

(56) References Cited

U.S. PATENT DOCUMENTS 5,904,280 A * 5/1999 Chan ..... 224/219
7,562,995 B1 * 7/2009 Levine ..... 362/197
7,575,347 B1 * 8/2009 Daly ..... 362/398

* cited by examiner

*Primary Examiner* — Evan Dzierzynski
(74) *Attorney, Agent, or Firm* — Bacon & Thomas, PLLC

(57) ABSTRACT

An illumination device for tool (e.g., screw driver) includes a housing comprising a battery compartment an inverted V-shaped cavity on an underside, two opposite slit projections on a bottom edge, and a cover including a flat on a circumferential surface; a strap having one end hingedly secured to one projection and comprising a hook and loop fabric fastener at the other end; first, second, and third magnetic members on the housing; and a light emitting assembly mounted in the housing and comprising two LEDs projecting out of the housing. A screw driver can be disposed in the inverted V-shaped cavity and adhered to the first magnetic members such that causing the strap to support the screw driver from below and wrapping the strap around the other projection to secure to the hook and loop fabric fastener will secure the screw driver and the housing together.

8 Claims, 9 Drawing Sheets

MAGNETIC ILLUMINATION DEVICE FOR TOOL

BACKGROUND OF THE INVENTION

1. Field of Invention

The invention relates to illumination devices and more particularly to such an illumination device having a magnetic arrangement adapted to releasably secure to one of a variety of tools or a metal object.

2. Description of Related Art

It is often that a user may use a tool to work in a dark environment. Hence, an auxiliary illumination device (e.g., flashlight) is required to illuminate a working area of the tool (e.g., screw driver) held by a user. However, the user has to use one hand to hold the flashlight and the other hand to hold the screw driver to work. This is inconvenient and can hinder work.

Taiwanese Utility Model Patent Nos. 309,642 and 484,492 each discloses an illumination device releasably mounted on a tool (e.g., screw driver) so as to facilitate a user to use the screw driver in a dark environment. However, the illumination devices of these patents are not adaptable. In brief, they are specially designed to cooperate with one type of tool only. Thus, the need for improvement still exists.

SUMMARY OF THE INVENTION

It is therefore one object of the invention to provide an illumination device having a magnetic arrangement adapted to releasably secure to one of a variety of tools or a metal object.

The above and other objects, features and advantages of the invention will become apparent from the following detailed description taken with the accompanying drawings.

DETAILED DESCRIPTION OF THE INVENTION

Figure 1:
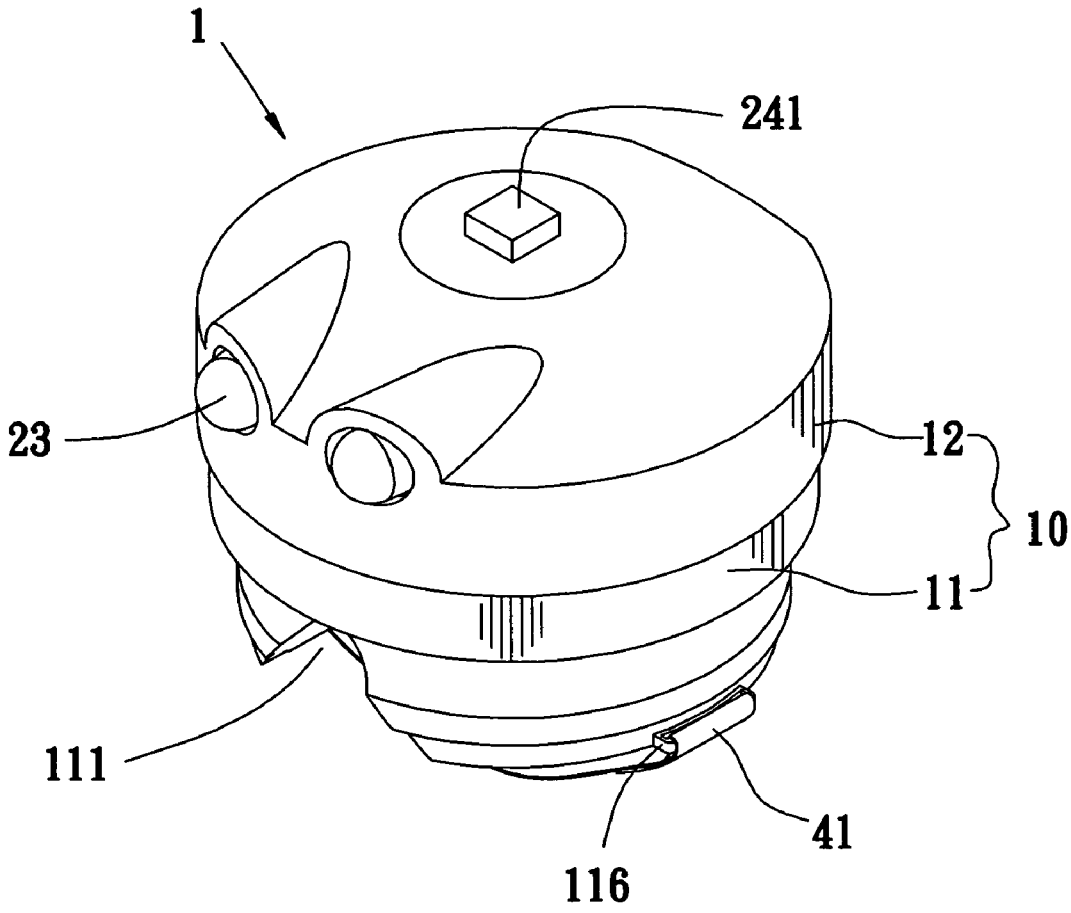
FIG. 1 is a perspective view of a first preferred embodiment of illumination device for tool according to the invention.
Figure 2:
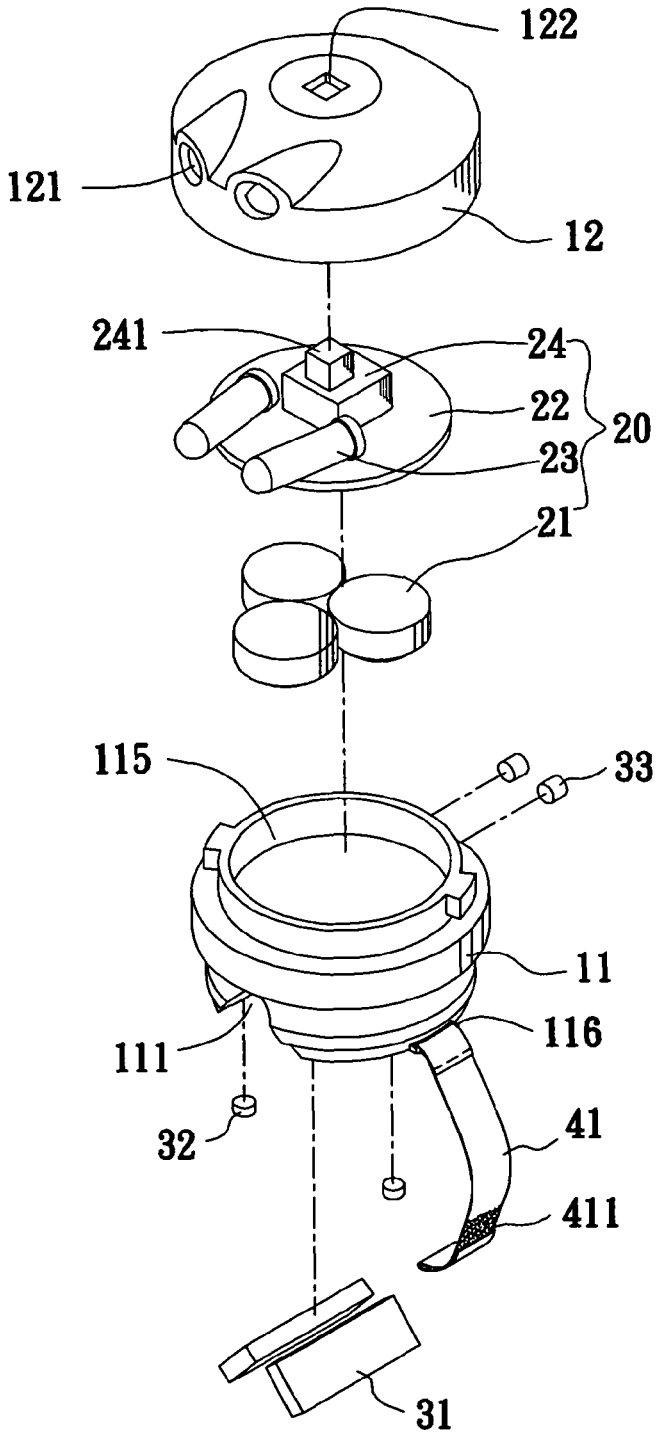
FIG. 2 is an exploded view of the illumination device shown in FIG. 1.
Figure 3:
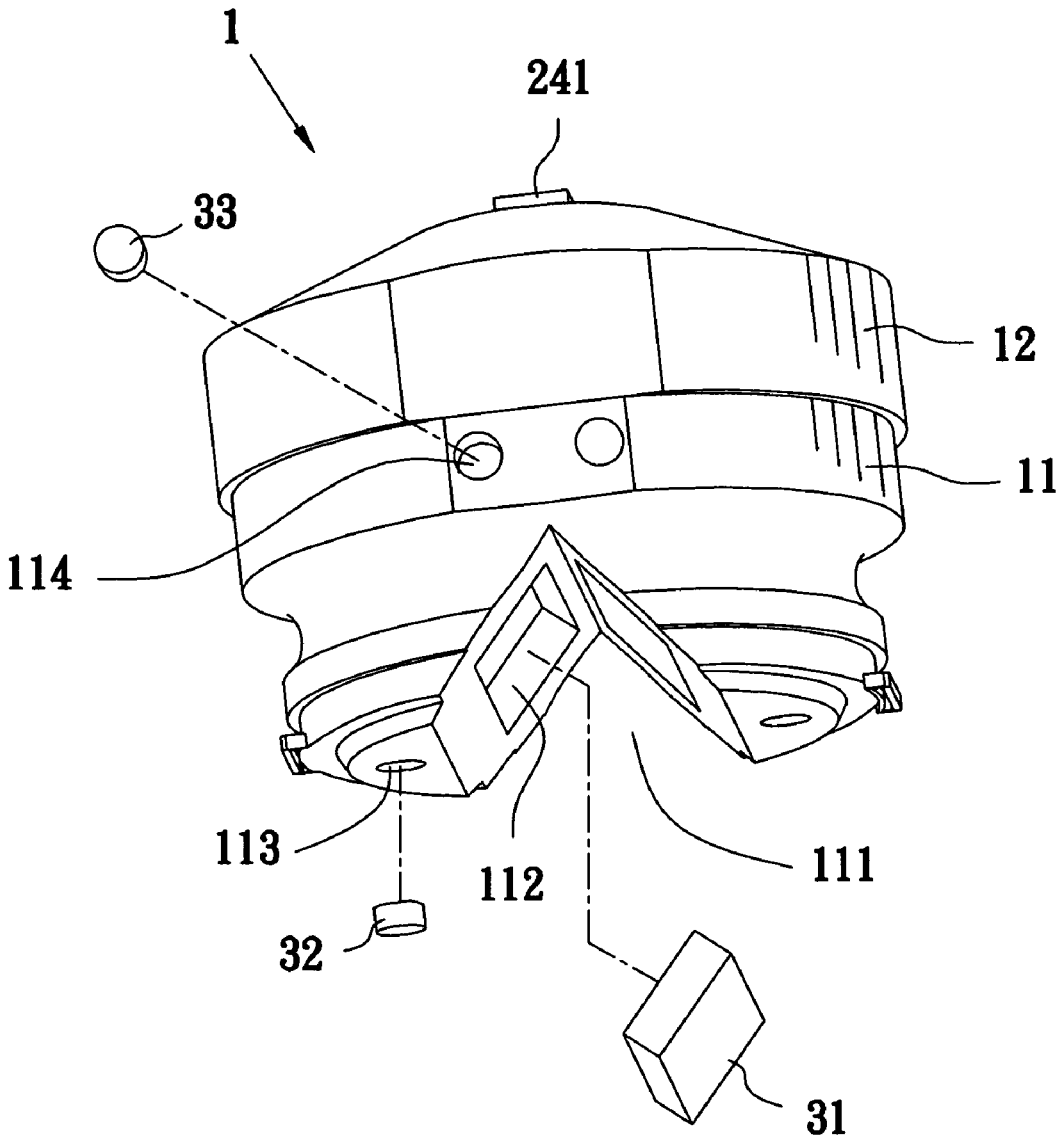
FIG. 3 is an exploded perspective view of the illumination device shown in FIG. 1 where a first configuration of the first receiving spaces is shown.
Figure 4:
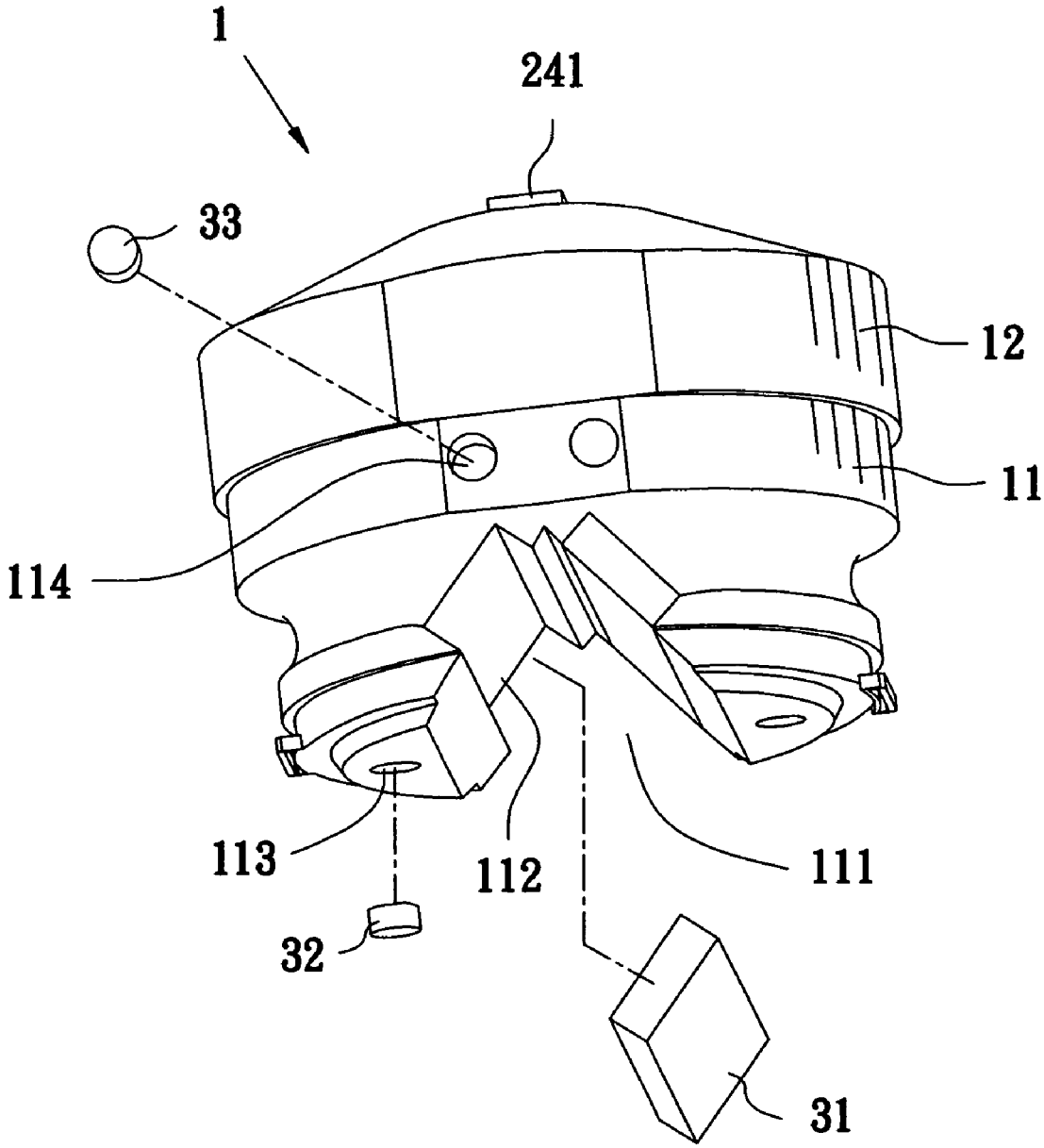
FIG. 4 is a view similar to FIG. 3 where a second configuration of the first receiving spaces is shown.
Figure 5:
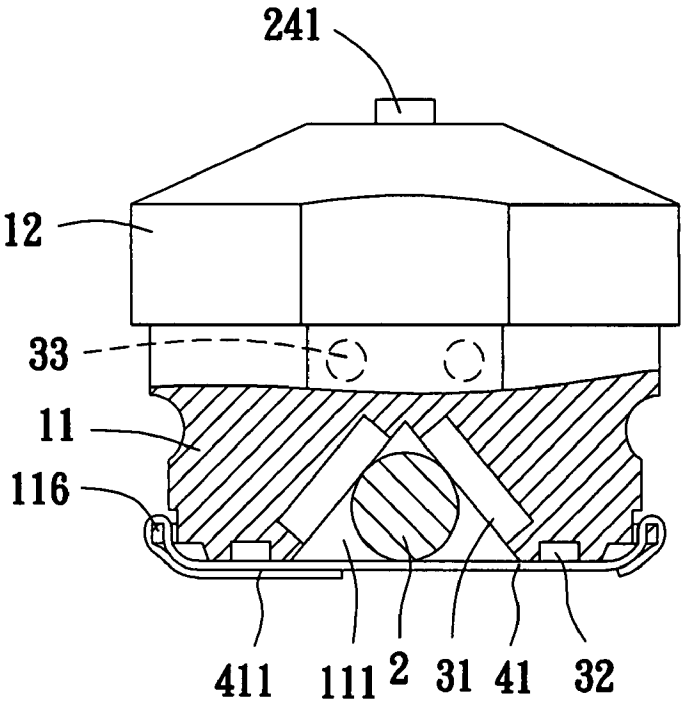
FIG. 5 is a longitudinal sectional view of the illumination device shown in FIG. 1 where a first type of screw driver is secured to the illumination device.
Figure 6:
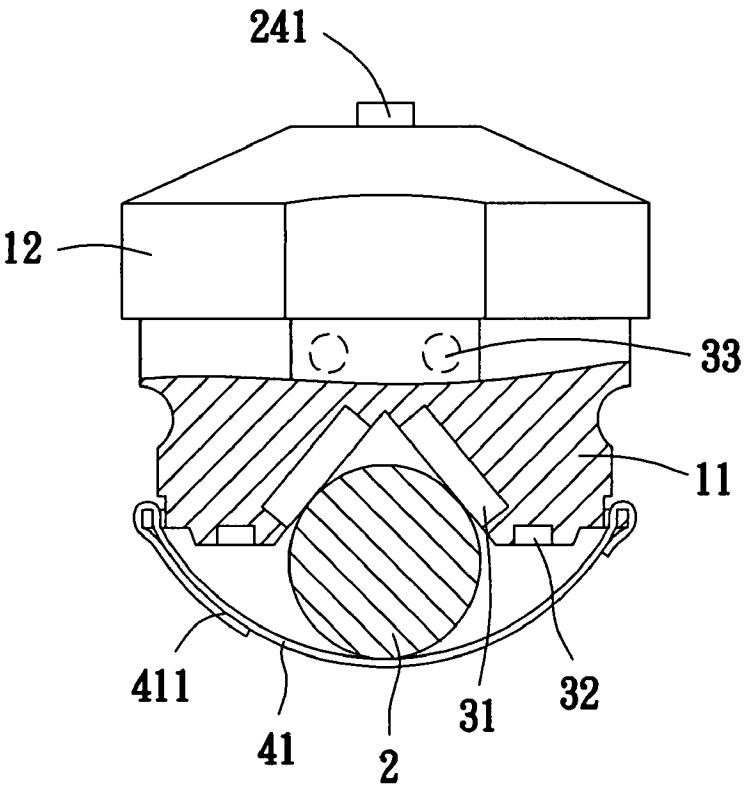
FIG. 6 is a view similar to FIG. 5 where a different second type of screw driver is secured to the illumination device.
Figure 7:
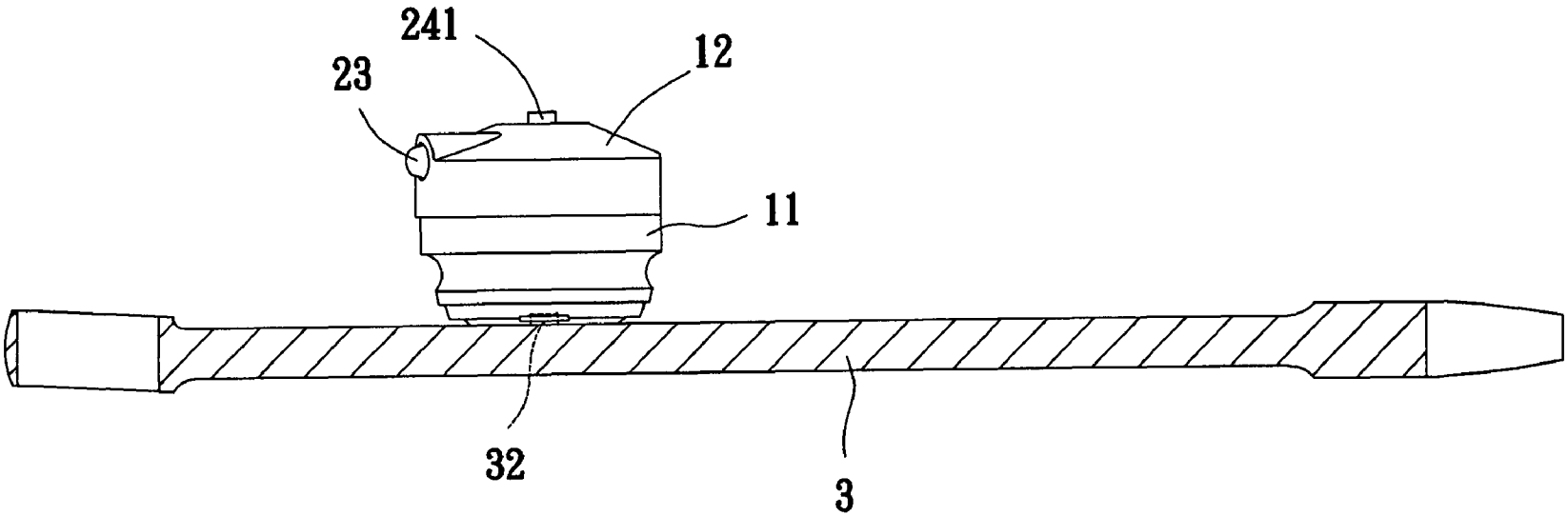
FIG. 7 is a perspective view of the illumination device being adhered to a wrench.
Figure 8:
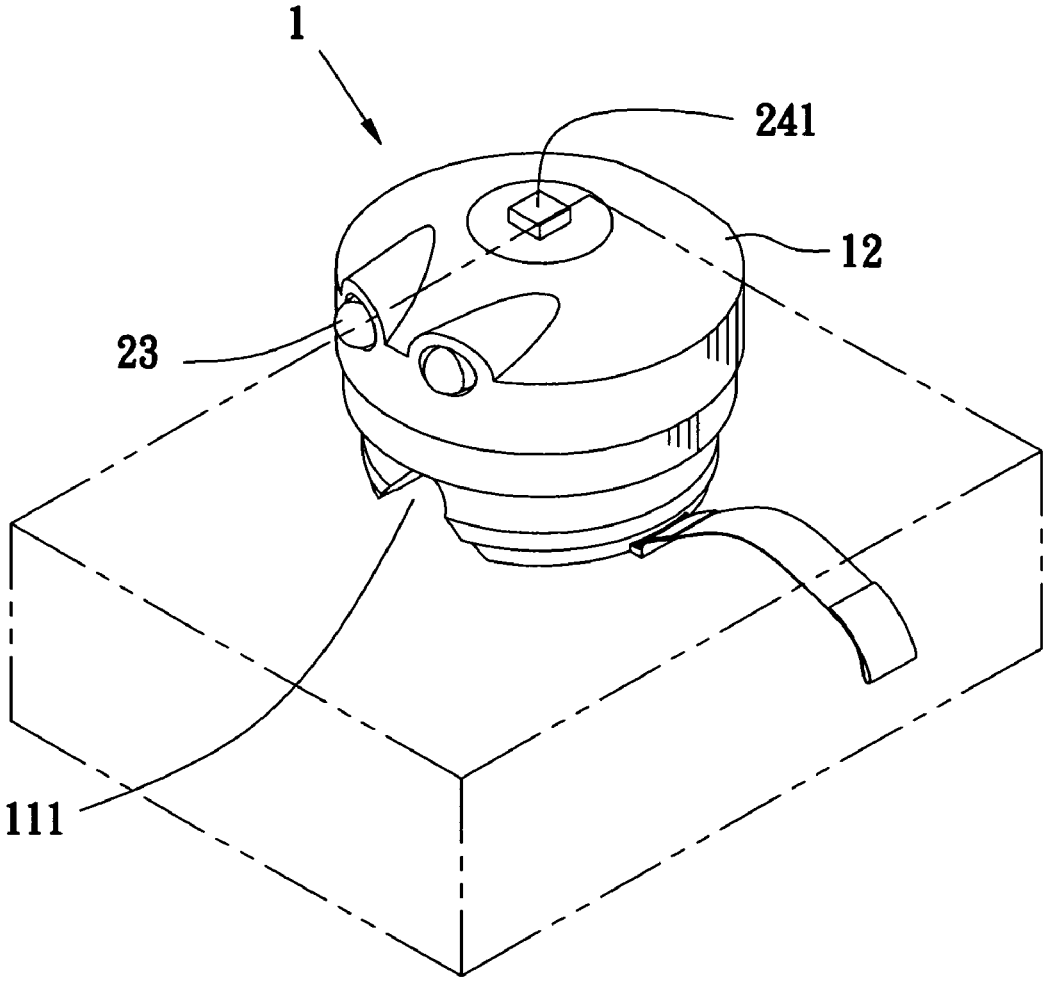
FIGS. 8 and 9 are perspective views of the illumination device horizontally and vertically adhered to a metal object respectively.
Figure 9:
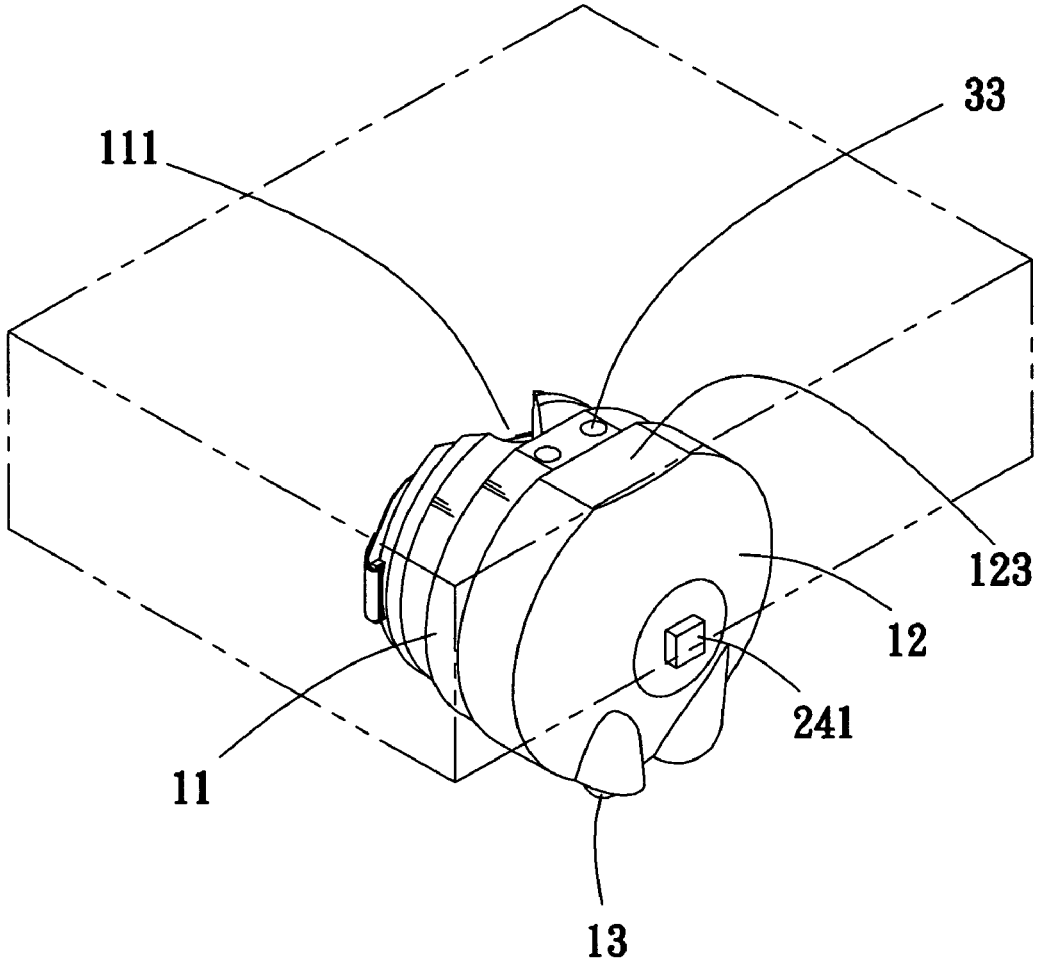

Referring to FIGS. 1 to 9, an illumination device 1 for tool in accordance with a first preferred embodiment of the invention comprises the following components as discussed in detail below.

A cylindrical housing 10 comprises a base 11 and a cover 12 releasably secured together. An internal space 115 used as a battery compartment is defined by the base 11. The base 11 comprises an inverted V-shaped cavity 111 on an underside, the inverted V-shaped cavity 111 having two opposite first-receiving spaces 112 on both inclined sides; two second receiving spaces 113 on the underside of the base 11 and spaced from both sides of the inverted V-shaped cavity 111; and two spaced third receiving spaces 114 formed on a flat on an outer surface of the base 11 and being disposed above the inverted V-shaped cavity 111.

First, second, and third magnetic members 31, 32, and 33 are provided in the first, second, and third receiving spaces 112, 113, and 114 respectively. Alternatively, a second configuration of the first receiving spaces 112 other than one shown in FIG. 3 can be implemented in FIG. 4.

The base 11 further comprises two opposite slit projections 116 on a bottom edge. The shank of a tool (e.g., screw driver) 2 is disposed in a space between the first magnetic members 31 and adhered to the first magnetic members 31. A strap 41 has one end secured to one projection 116 (i.e., hingedly secured thereto) and the other end provided with a hook and loop fabric fastener 411 wrapping around the other projection 116 to secure to itself after tightly contacting a bottom of the shank of the screw driver 2 (see FIGS. 3 and 4). As a result, the screw driver 2 and the illumination device 1 are secured together.

The cover 12 comprises two forward holes 121 on a top edge, an opening 122 on a center of the top, and a flat 123 on a circumferential surface opposing the holes 121. The flat 123 is adjacent the third receiving spaces 114.

A light emitting assembly 20 comprises three cells 21 tightly provided in the battery compartment 115 and a circular circuit board 22 provided on the cells 21 and electrically connected thereto. A switch 24 is provided on a top center of the circuit board 22 and has a depressible push button 241 projecting out of the opening 122 for on/off operation of the switch 24. Two cylindrical LEDs (light-emitting diodes) 23 are provided on the circuit board 22 and electrically connected thereto. The LEDs 23 have open ends slightly projecting out of the holes 121 and retained therein. The LEDs 23 are adapted to emit light rays to illuminate a working area pointed by the tool fastened by the illumination device 1.

The first magnetic members 31 are parallelepiped. The second magnetic members 32 are cylindrical and are adapted to adhere to a wrench 3 (see FIG. 7). Alternatively, the second magnetic members 32 are adhered onto a metal object (not numbered) when the illumination device 1 is disposed upright thereon (see FIG. 8). Still alternatively, the third magnetic members 33 are adhered to a bottom of a metal object (not numbered) when the illumination device 1 is disposed horizontally thereunder (see FIG. 9). In view of the above, the invention is adaptable.

Figure 10:
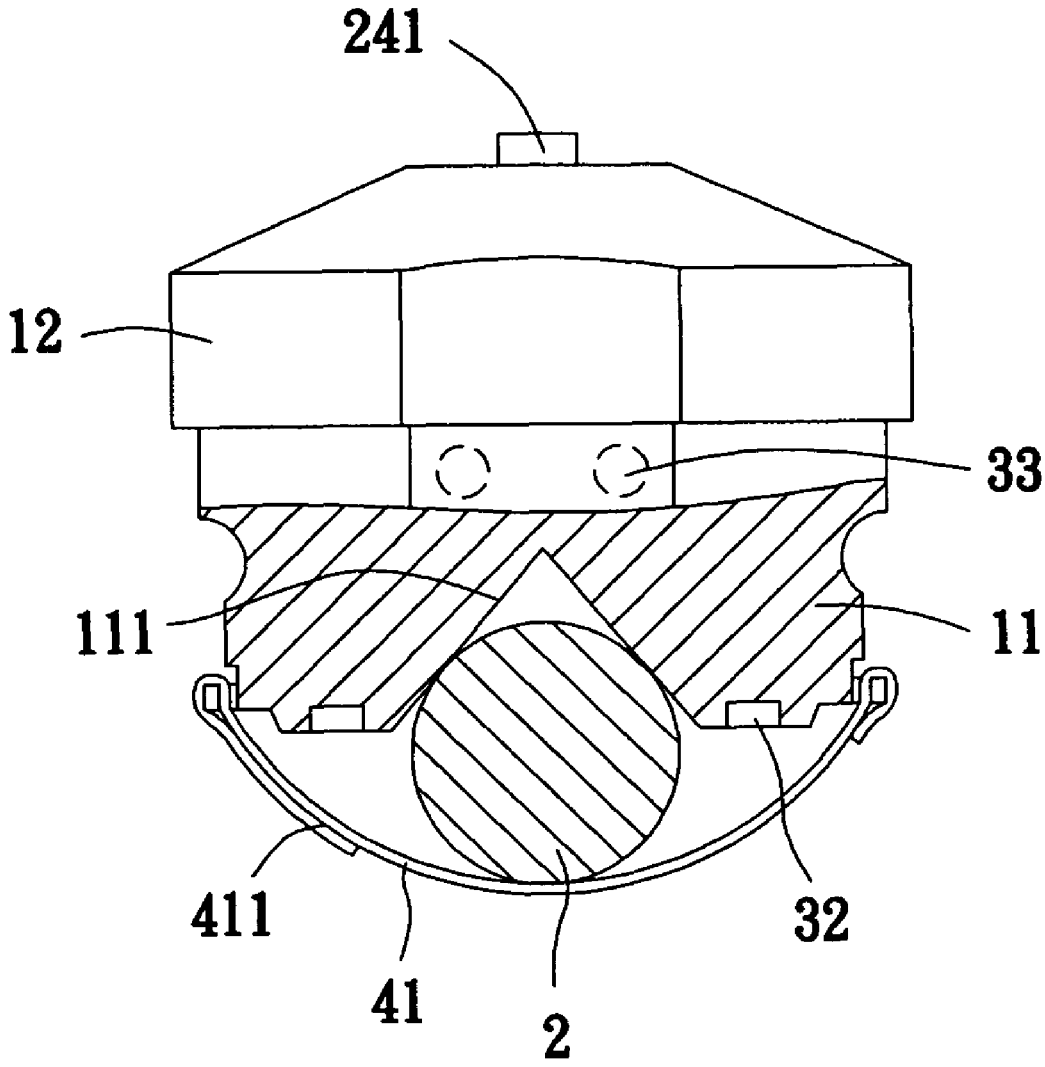
FIG. 10 is a longitudinal sectional view of a second preferred embodiment of illumination device for tool according to the invention with a screw driver being secured thereto.

Referring to FIG. 10, an illumination device for tool in accordance with a second preferred embodiment of the invention is shown. The second embodiment is identical to the first embodiment, except that the first receiving spaces and the first magnetic members are eliminated. Hence, the fastening of a tool (e.g., screw driver) 2 is completely done by urging the screw driver 2 against the inverted V-shaped cavity 111 by tightening the strap 41. The second embodiment has fewer components than the first one.

While the invention herein disclosed has been described by means of specific embodiments, numerous modifications and variations could be made thereto by those skilled in the art without departing from the scope and spirit of the invention set forth in the claims.

What is claimed is:

1. An illumination device comprising:

a housing (10) comprising a base (11) including a battery compartment (115) an inverted V-shaped cavity (111) formed on an underside, the inverted V-shaped cavity (111) having two opposite first receiving spaces (112) on both inclined sides, two second receiving spaces (113) on the underside of the base (11) and spaced from both sides of the inverted V-shaped cavity (111), two spaced third receiving spaces (114) formed on an outer surface of the base (11) and being disposed above the inverted V-shaped cavity (111), and two opposite slit projections (116) on a bottom edge of the base (11) adjacent the second receiving spaces (113) respectively; and a cover (12) releasably secured to the base (11), the cover (12) including a flat (123) on a circumferential surface, the flat (123) being adjacent the third receiving spaces (114);

a strap (41) having one end hingedly secured to one projection (116) and comprising a hook and loop fabric fastener (411) at the other end;

first, second, and third magnetic members (31, 32, 33) disposed in the first, second, and third receiving spaces (112, 113, 114) respectively; and a light emitting assembly (20) comprising a plurality of cells (21) disposed in the battery compartment (115), a circuit board (22) disposed on the cells (21) and electrically connected thereto, a switch (24) electrically connected to the circuit board (22) and partially protruding out of a top of the cover (12), and light emitting means (23) electrically connected to the circuit board (22) and projecting out of the cover (12), wherein (i) a first type of metal tool (2) can be disposed in the inverted V-shaped cavity (111) and adhered to the first magnetic members (31) such that causing the strap (41) to support the first type of metal tool (2) from below and wrapping the strap (41) around the other projection (116) to secure to the hook and loop fabric fastener (411) will secure the first type of metal tool (2) and the housing (1) together; or (ii) the second magnetic members (32) can be adhered to a second type of metal tool (3).

2. The illumination device of claim 1, wherein the light emitting means (23) comprises two spaced LEDs.

3. The illumination device of claim 1, wherein the first type of metal tool (2) is a screw driver.

4. The illumination device of claim 1, wherein the second type of metal tool (3) is a wrench.

5. An illumination device comprising:

a housing (10) comprising a base (11) including a battery compartment (115) an inverted V-shaped cavity (111) formed on an underside, and two opposite slit projections (116) on a bottom edge of the base (11) adjacent the second receiving spaces (113) respectively; and a cover (12) releasably secured to the base (11), the cover (12) including a flat (123) on a circumferential surface, the flat (123) being adjacent the third receiving spaces (114);

a strap (41) having one end hingedly secured to one projection (116) and comprising a hook and loop fabric fastener (411) at the other end;

second magnetic members (32) disposed on the underside of the base (11) and spaced from both sides of the inverted V-shaped cavity (111);

third magnetic members (33) disposed on an outer surface of the base (11) and being disposed above the inverted V-shaped cavity (111); and a light emitting assembly (20) comprising a plurality of cells (21) disposed in the battery compartment (115), a circuit board (22) disposed on the cells (21) and electrically connected thereto, a switch (24) electrically connected to the circuit board (22) and partially protruding out of a top of the cover (12), and light emitting means (23) electrically connected to the circuit board (22) and projecting out of the cover (12), wherein (i) a first type of metal tool (2) can be disposed in the inverted V-shaped cavity (111) such that causing the strap (41) to support the first type of metal tool (2) from below and wrapping the strap (41) around the other projection (116) to secure to the hook and loop fabric fastener (411) will secure the first type of metal tool (2) and the housing (1) together; or (ii) the second magnetic members (32) can be adhered to a second type of metal tool (3).

6. The illumination device of claim 5, wherein the light emitting means (23) comprises two spaced LEDs.

7. The illumination device of claim 5, wherein the first type of metal tool (2) is a screw driver.

8. The illumination device of claim 5, wherein the second type of metal tool (3) is a wrench.

* * * * *